US005553338A

United States Patent [19]

Amann

[11] Patent Number: 5,553,338

[45] Date of Patent: Sep. 10, 1996

[54] PRONE-POSITION SURFACE WITH AT LEAST THREE LATHWORK LAYERS

[75] Inventor: Günther Amann, Frastanz, Austria

[73] Assignee: Lokosana AG, Rheineck, Switzerland

[21] Appl. No.: 260,342

[22] Filed: Jun. 15, 1994

[30] Foreign Application Priority Data

Jun. 18, 1993 [DE] Germany ..... 43 20 168.7

[51] Int. Cl.[6] ..... A47C 23/06; A47C 27/16; A47C 27/15

[52] U.S. Cl. ..... 5/236.1; 5/191

[58] Field of Search ..... 5/236.1, 237, 238, 5/191, 462, 464

[56] References Cited

U.S. PATENT DOCUMENTS 2,414,978 1/1947 Richardson ..... 5/237

FOREIGN PATENT DOCUMENTS 0011755 6/1980 European Pat. Off. ..... 5/464
0397069 5/1990 European Pat. Off. .
0385121 11/1993 European Pat. Off. .
56259 9/1952 France .
2446092 9/1980 France ..... 5/462
315949 5/1918 Germany .
9115322 4/1992 Germany .
4114417 11/1992 Germany .

*Primary Examiner*—Alexander Grosz
*Attorney, Agent, or Firm*—Brown, Martin, Haller & McClain

[57] ABSTRACT

A lying support such as a bed comprising upper and lower layers of mutually parallel spaced-apart wooden slats and an additional layer of slats positioned between the upper and lower layers. The upper and lower layers of slats are fastened to at least two spaced elastic bodies, which may each comprise upper and lower fabric covered cushion bodies, by straps. Each slat of the additional layer may pass through apertures in the elastic bodies or may be held by straps connected to one or more cushion bodies on one side of the slat only. Selective dimensioning and positioning of the slats in the additional layer permits the lying support to conform in an optimum manner to different parts of a human body and to a light or heavy body.

16 Claims, 4 Drawing Sheets

PRONE-POSITION SURFACE WITH AT LEAST THREE LATHWORK LAYERS

FIELD OF THE INVENTION

The present invention relates to a slatted grid lying support in which mutually parallel slats are connected to each other by spaced elastic bodies.

A lying support of this kind is already known from EP-A-0 385 121. This known lying support comprises upper and lower rows of parallel slats which are connected to each other by elastic bodies extending transversely to the slats. The elastic bodies include straps at their top and bottom into which the slats are inserted. A disadvantage with this known lying support with only two levels of slats is that when subjected to high loads by a heavy person lying thereon, unfavourable distribution of pressure in the lying surface occurs.

When this known lying support rests on side frame parts of a bedstead and is loaded with a bodyweight of about 70–80 kilograms, then an upwards counterpressure comes from the lower layer of the support with a force of about 30 kilograms. With a person of normal weight it is thus ensured that owing to counterpressure the lying support adapts to body contours in such a way that the buttocks and shoulder region are optimally supported. With an overweight person (e.g. with a bodyweight of 120 kilograms), the result is that the lying support is fully loaded but the counterpressure which acts upwardly from the lower layer of slats is still 30 kilograms. Therefore, there is inadmissible deflection of the upper layer of slats, which leads to sagging or in any case not optimum adaption to body contours.

OBJECT OF THE INVENTION

It is therefore an object of the present invention to develop a lying support of the kind mentioned hereinbefore such that even in a case of high loading of the lying support by a heavy bodyweight, a favourable distribution of pressure over the lying support and optimum adaption to body contours is achieved.

SUMMARY OF THE INVENTION

Thus according to the invention there is provided a slatted grid lying support comprising an upper layer of mutually parallel spaced-apart slats, a lower layer of mutually parallel spaced-apart slats, an additional layer of slats arranged between said upper and lower layers of slats and at least two mutually spaced elastic bodies with slat fastening straps on upper and lower sides thereof, wherein said elastic bodies extend perpendicular to said slats and between said upper and lower layers of slats and ends of said upper and lower slats are fastened by insertion into said straps.

It is an essential characteristic of the invention that at least one additional layer of slats is arranged between the upper layer and lower layer of slats of the lying support.

With such an arrangement there is obtained the essential advantage that now the counterpressure from below which is produced is provided by at least two spaced-apart layers of slats so producing a counterpressure which is substantially higher than with known lying surfaces.

Thus, it is possible for the lowermost layer of slats to produce a counterpressure of 30 kilograms and for the additional middle layer of slats located above it also to produce a counterpressure of 30 kilograms, so that together there is the substantially higher counterpressure of about 60 kilograms and this causes the upper layer of slats to conform in an optimum manner to body contours of the overweight person.

Preferably the additional layer of slats is not located in the middle between the upper and lower layers of slats. The middle layer of slats may for example be arranged in the upper third of the lying support.

If the lying support is turned over in such a way that the middle layer of slats is located in the lower third of the cushion body, then a softer lying surface is provided. This arrangement can be used for lighter persons, and improved conforming to the lighter persons' body contours will be provided. Softer lying surface results due to the fact that the counterpressure which is produced on the upper layer of slats from the middle and lower layers of the slats is not so strong, because the two said layers, namely the lower and middle ones, are relatively far away from the upper ones. If the lying support is now turned over the middle layer of slats which was previously in the lower third comes into the upper third and is now located a relatively short distance from the layer of slats which is now on top. This orientation of the lying support is intended for heavy persons, because the middle layer of slats (which is actually located in the upper third of the lying support) now produces a strong counterpressure on the upper layer of slats and hence also high counterforces are provided. In this way adaption to heavy bodyweights is also ensured which can prevent the body sagging.

In addition to or instead of the possibility of arranging the additional middle layer of slats at different distances from the upper and lower layers of slats respectively, there are several other possibilities for arranging the slats relative to each other.

The slats of the middle layer may be arranged staggered from the slats of the lower layer. With such an arrangement of the slats weight or compressive force is applied to the elastic bodies more evenly, which results in more even distribution of pressure.

An embodiment which proves particularly inexpensive to manufacture is one in which only every other slat of the middle layer is provided, i.e. the lower layer of slats has twice as many slats as the middle layer. The slats of the upper and middle layers may also be arranged staggered from the slats of the lower layer.

The slats of the middle layer may be arranged only in lying support regions likely to be subjected to high compressive stress, namely in the shoulder and buttock regions of the lying support. With such an arrangement it is ensured that the slats of the middle layer are arranged or provided only where they are actually used. Hence a significant number of slats can be dispensed with. This results in a not unnecessarily heavy construction, and a saving of production costs and effort.

Preferably the distances between the slats of the lower layer are not uniform. The slats of the lower layer in the region of high body support, namely in the region of shoulder, back and buttocks, are located closer together than the slats in the head region and in the foot region. Production costs can thereby be reduced still further.

The thickness of slats in the middle layer may be smaller than the thickness of slats in the upper layer or the lower layer. The slats may conveniently be of wood.

In order to save costs, slats in the middle layer may be wider than slats in the upper and lower layers.

The requirement for a relatively high number of slats in the upper and lower layers is due to the fact that these layers need to adapt to body contours in an optimum manner. This is however not so in the case of the middle layer of slats, which only acts to produce the necessary upward counterpressure. Therefore, a smaller number of wider slats may be used in the middle layer.

Preferably provision is made for fixing the slats of the middle layer to the elastic bodies and any middle cushion body by inserting these slats into corresponding cloth pockets of a strap band, as described in European Patent Application EP-A-0 385 121, already mentioned in the introduction to the specification.

Preferably the elastic bodies are provided with a horizontal dividing plane in the longitudinal direction which divides the elastic bodies into upper and lower portions. Both portions are preferably constructed as individual cushion bodies and clad with a cover. Only one cushion body of each elastic body includes straps for supporting the middle layer of slats on the side facing towards the dividing plane. These individual cushion bodies are placed one on top of the other and are then connected to each other at least in regions along the edges adjoining the dividing plane. In this case at least one of the cushion bodies comprises, on the side of each elastic body facing towards the dividing plane, strap bands, in which the slats of the middle layer are inserted.

In an alternative embodiment it is proposed not to construct the cushion bodies continuously over the whole length of the lying support. Instead each cushion body may for example be in the form of three cushion bodies arranged in a row one behind the other and connected to each other at end faces facing towards each other. This has the advantage for production that the middle portion of the lying surface can be constructed differently to the outer portions or ends. This affords the possibility of the middle layer of slats according to the invention being mounted only in the middle portion of these three cushion bodies, while being absent in the outer portions or ends of the lying support.

With such division of the lying surface into three, there is the further advantage that a sitting position with the head portion raised or a corresponding lying position with the foot portion raised can be achieved.

In another preferred embodiment, instead of the elastic bodies being provided with cloth sheaths, a latex cushion body without a cloth sheath may be used. With this arrangement, in each case, at the point at the which the middle layer of slats is to be arranged, recesses are arranged in the cushion body, in which the slats engage and are held. The sewing up of the cover and sewing on of corresponding strap bands is thus eliminated, so that the production costs can be distinctly reduced.

Finally, in a still further embodiment individual cushion bodies are used instead of a continuous elastic body. A latex ball is associated with each slat of the upper and lower layers which on mutually opposed sides is fixed to the upper and lower slats respectively. The cushion body is therefore not rectangular and continuous but is comprised of separate cushion bodies individually spaced apart from each other. A latex ball of this kind is associated with the upper and lower slats (which are arranged in alignment with each other).

Instead of a quadrangular (rectangular) cushion body, a cushion body of round profile can be used.

Further characteristics essential to the invention and advantages of the invention are apparent from the following drawings and description of a preferred embodiment of the invention.

DETAILED DESCRIPTION OF THE DRAWINGS

With respect to the exact design of the straps and strap bands for fixing the slats to the elastic bodies, reference is made to the applicants' European patent application EP-A-0 385 121, the content of which is not intended to be the disclosure content of the present specification.

In FIGS. 1–4 a lying support 1 is shown which consists of a plurality of spaced parallel slats 4, 5 and 6 which form the middle, lower and upper layers of slats respectively.

The slats 4, 5 and 6 are preferably made of a solid wood material with a width of about 3 cm and a thickness of about 8 mm. Adjacent slats in the upper and lower layers are spaced about 1.5 to 2.0 cm apart.

Figure 4:
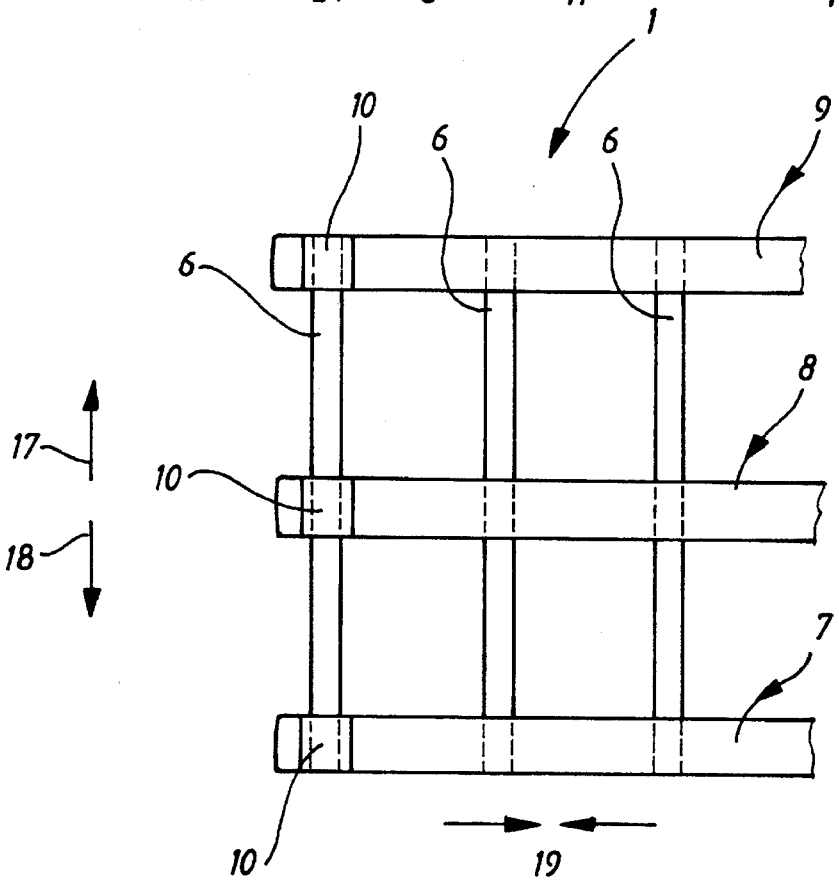
FIG. 4—a top view of part of the lying support shown in FIG. 3.
Figure 6:
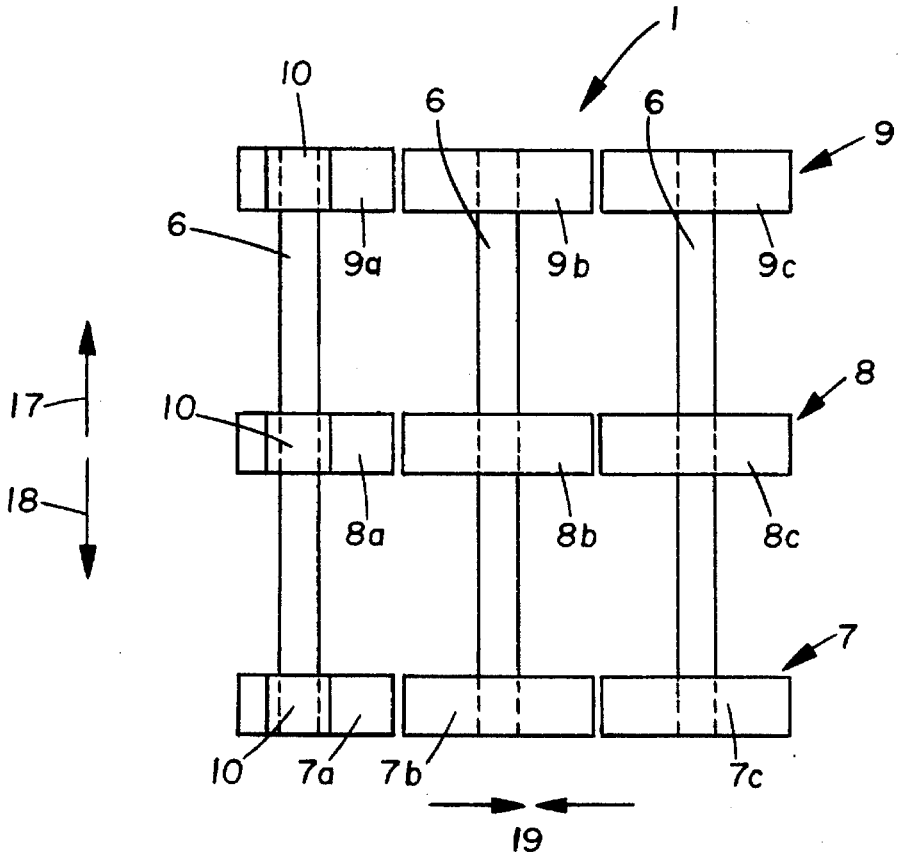
FIG. 6 is a view similar to FIG. 4 illustrating a modification in which each cushion body is in the form of three cushion bodies aligned in series.

In order to provide the lying support with a spring action mutually spaced elastic bodies 7, 8 and 9 are provided. These elastic bodies extend parallel to each other in the direction of the longitudinal extent of the lying support 1 as shown in FIG. 4. In FIG. 4, each elastic body is made as a continuous, one-piece member. Alternatively, as illustrated in FIG. 6, the elastic bodies may be in the form of three cushion bodies 7*a*, 7*b*, 7*c*, 8*a*, 8*b*, 8*c*, and 9*a*, 9*b*, 9*c*, respectively. The cushion bodies are arranged in a row one behind the other and connected to each other at end faces facing towards each other.

In the practical example shown here, each of the elastic bodies 7, 8 and 9 is composed of two cushion bodies 15 and 16 which are located one on top of the other above and below a horizontal dividing plane 33 and connected to each other in the regions 34 and 35. Each of the cushion bodies 15 and 16 is surrounded by a cover 12 of textile material and these covers 12 are sewn together along the edges adjoining the dividing plane to effect interconnection of the cushion bodies.

Figure 1:
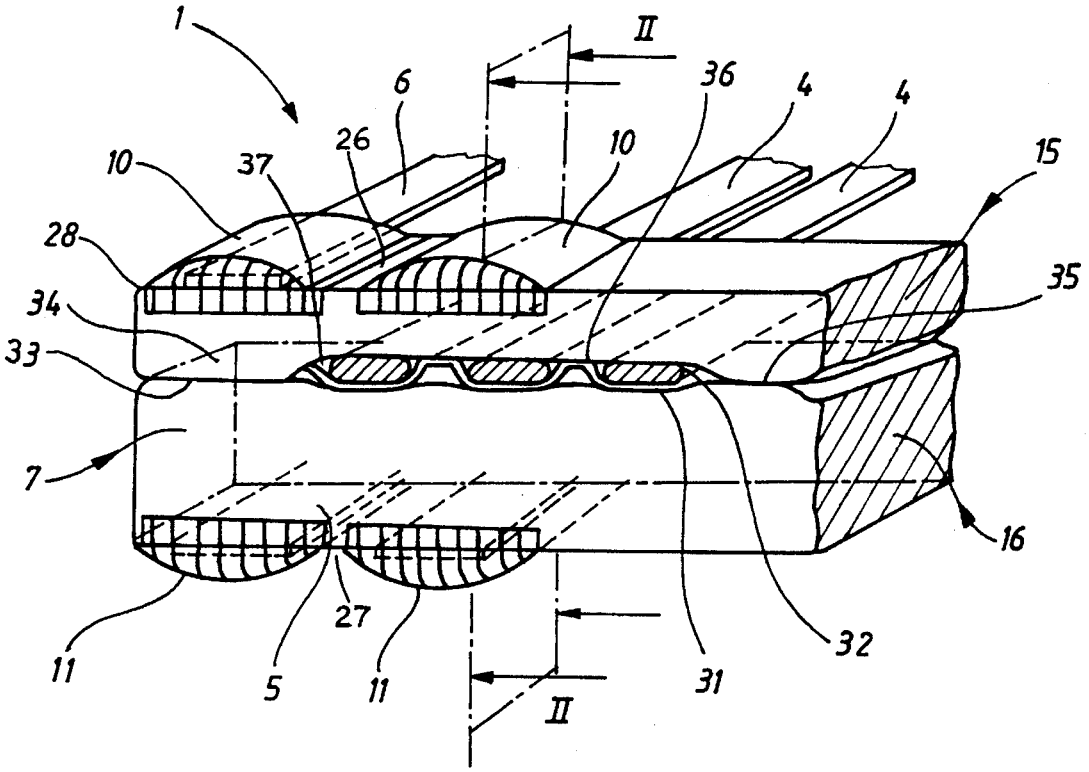
FIG. 1—a perspective side view of a part of a first embodiment of the lying support according to the invention.

As shown in FIG. 1, between the cushion body 15 and the cushion body 16 in the region of the dividing plane 33 slats 4 are arranged which are inserted in straps 32 which form recesses 37 into which the ends of the slats 4 are inserted. These straps 32 are formed by a strap band 31 which is formed on the lower side of the cushion body 15 at intervals in the longitudinal direction of the elastic body 7 by means of tucks or attachment points 36. The straps 32 with the slats 4 contained therein rest without fixed connection on the upper side of the cushion body 16. As a result of this arrangement the cushion body 16 is slidable in a longitudinal direction relative to the slats 4 or the straps 32. Accordingly in a situation of high compressive load due to weight on the lying support, distortion of the cover 12 of the cushion body 16 is avoided. At the same time the slats 4, due to the fixed connection of the two cushion bodies 15 and 16 in the regions 34 and 35 are held by the tucks 36 in their position relative to the respective upper and lower slats 5 and 6.

Due to the fact that the slats 4 are only laterally inserted in the straps 32, the slats can be inserted or taken out at any point along the elastic body 7 if such straps 32 are provided there. Thus, the lying support can be adapted to suit the body size of a person lying thereon, so that the lying surface will adapt to the body contours of this person in an optimum manner.

Figure 2:
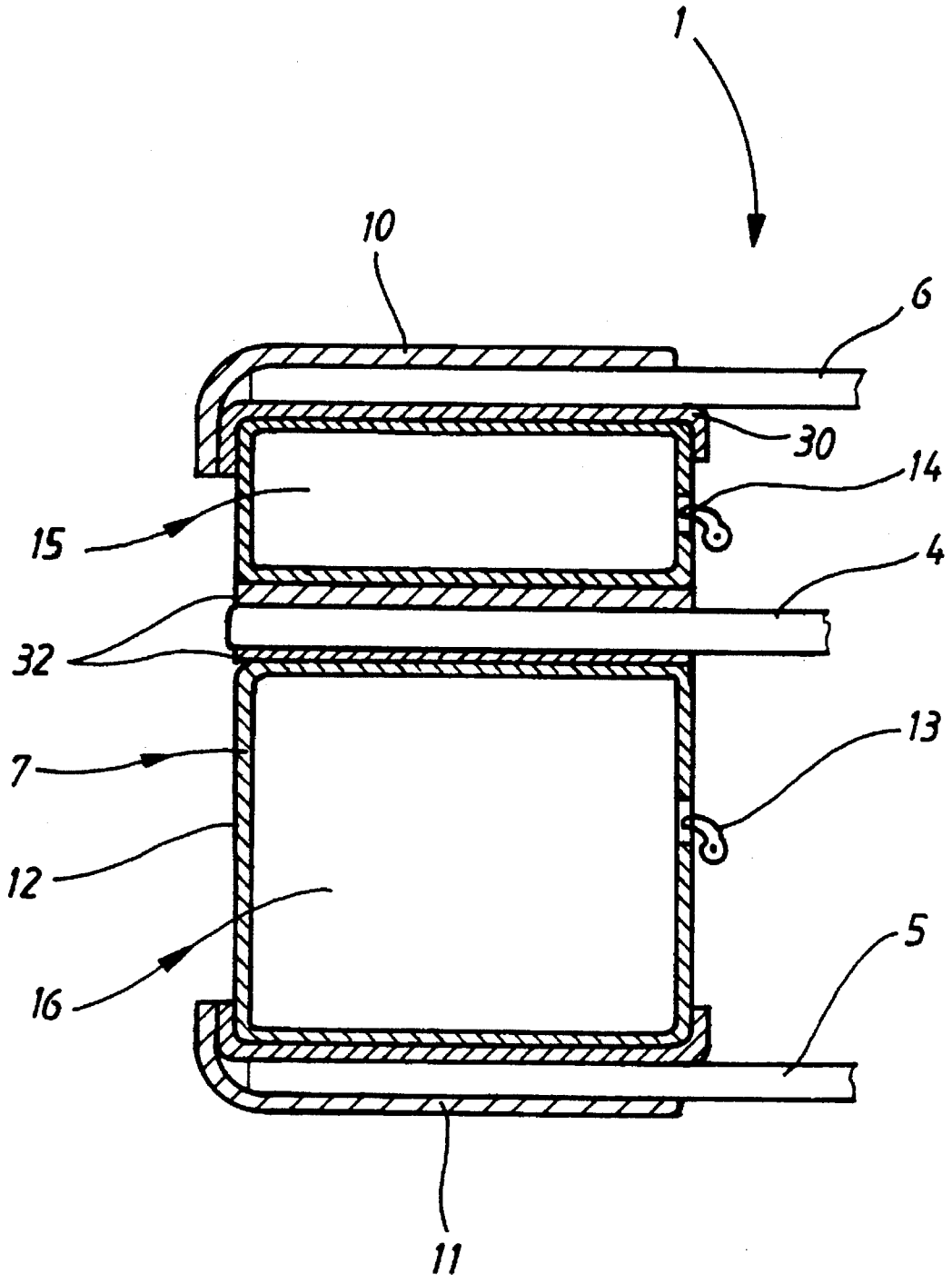
FIG. 2—a sectional view through the lying support along the section plane II in FIG. 1.
Figure 3:
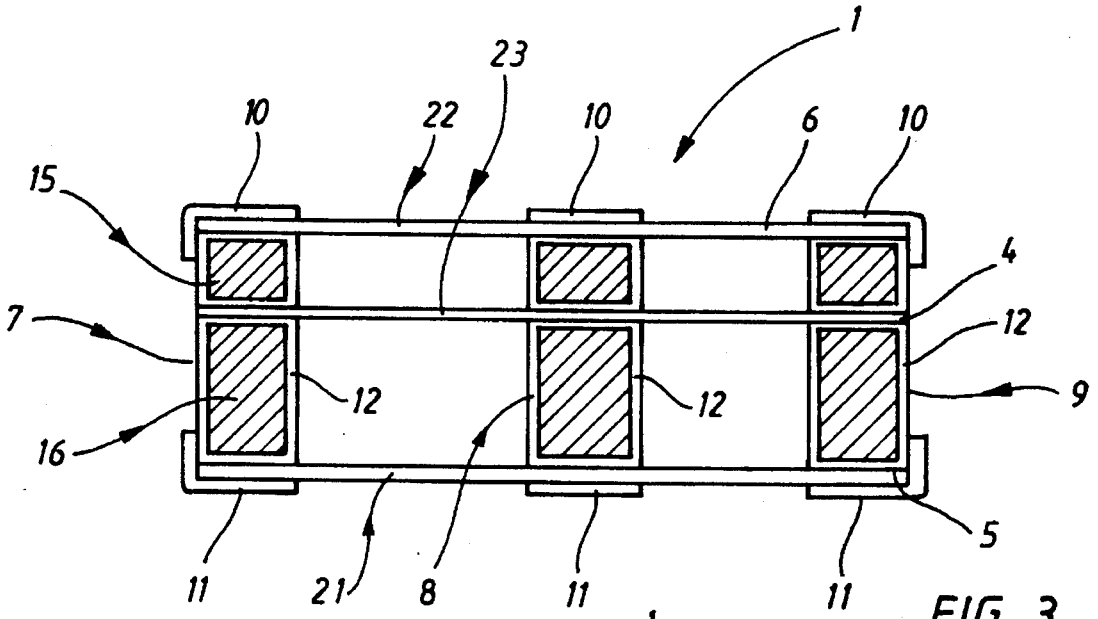
FIG. 3—a part sectional end view of the lying support.

In FIG. 2 it is further shown that in the region of support of the slats 5 and 6 a support 30 is provided on the cushion body 15 to prevent the cover 12 from wearing through.

Furthermore, the straps 10 and 11 are both pulled over an edge of the elastic bodies 7 and 9 as a result of which a fabric stop 28 is formed for each end face of the slats 5 and 6. This fabric stop 28 can be lifted in order to allow the slats 5 and 6 to be pulled out or passed through the elastic bodies completely.

The straps 10 and 11 are separated from each other by tucks 26 and 27 at the side edges respectively, so that there is a gap which is formed only from the material of the strap 10 and 11. In this region the tucks 26 and 27 are joined to the sheath 12 of the respective elastic bodies 7–9.

By opening the straps it is very easy to insert the slats 5 and 6 in the direction of arrows 17 and 18 into the straps 10 and 11. The slats 5 and 6 abut against the fabric stops 28 at their end faces. The same assembly arrangement also applies to the straps 32 arranged at the dividing plane 33 to accommodate the slats 4 of the middle layer according to the invention.

This arrangement further provides the possibility of displacing, for example the middle elastic body 8 with its cover 12 and the attached straps 10 and 11, in the direction of arrows 17 and 18, in order to adjust the total hardness of the lying surface.

Figure 5:
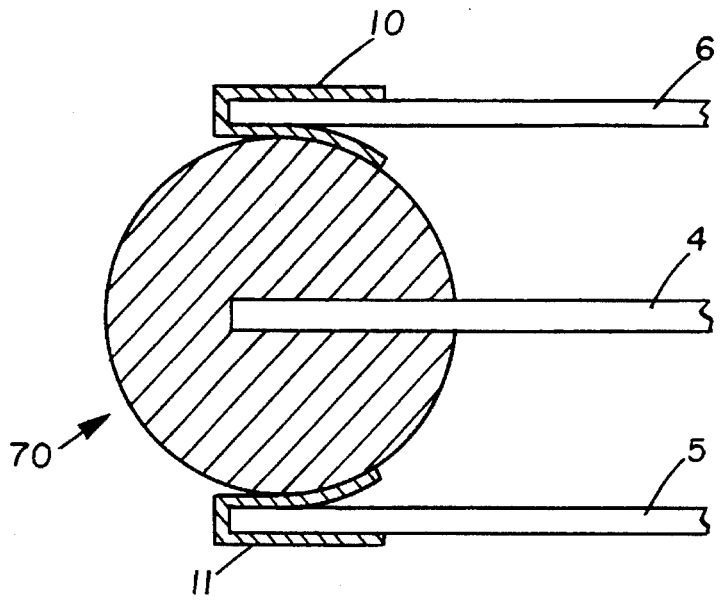
FIG. 5 is a sectional view of an alternative embodiment in which the slats are supported by latex balls.

FIG. 5 illustrates an alternative embodiment in which individual cushion bodies such as latex ball 70 are used for each elastic body. The latex ball is fixed to the upper and lower slats 6 and 5 on opposite sides of the ball 70 via straps 10,11. In this case, the cushion body is not rectangular and continuous but is comprised of separate latex balls, one associated with each pair of upper and lower slats. The latex balls are spaced apart from one another.

What is claimed is:

1. Slatted grid lying support comprising an upper layer of mutually parallel spaced-apart slats, a lower layer of mutually parallel spaced-apart slats, an additional layer of slats arranged between said upper and lower layers of slats and at least two mutually spaced elastic bodies with slat fastening straps on upper and lower sides thereof, wherein said elastic bodies extend perpendicular to said slats and between said upper and lower layers of slats and ends of said upper and lower slats are fastened by insertion into said straps;

said elastic bodies being provided in the longitudinal direction with a horizontal dividing plane which divides said elastic bodies into upper and lower portions, each of which is constructed as an individual cushion body and clad with a cover, and wherein at least one said cushion body includes on its side facing towards said dividing plane, straps for supporting slats of said additional layer, and cushion bodies constituting an elastic body are connected to each other at least in sections along edges adjoining said dividing plane.

2. Lying support according to claim 1, wherein slats of said additional layer are arranged offset from slats of said lower layer.

3. Lying support according to claim 1, wherein at least one of said upper and lower layers includes approximately twice as many slats as said additional layer.

4. Lying support according to claim 1, wherein slats of said additional layer are arranged only in regions of said support under high compressive stress.

5. Lying support according to claim 4, wherein slats of said additional layer are arranged in regions for supporting shoulders and pelvis of a person lying on said support.

6. Lying support according to claim 1, wherein slats of said lower layer are not equally spaced, wherein said slats in regions of high compressive load are located closer together than slats in other regions.

7. Lying support according to claim 6, wherein said slats of said lower layer are located closer together in regions for supporting shoulders, back and pelvis than in regions for supporting head and feet of a person lying on the support.

8. Lying support according to claim 1, wherein the thickness of slats of said additional layer is less than that of slats of said lower layer and upper layer.

9. Lying support according to claim 1, wherein wider slats are used in said additional layer of slats than in said upper and lower layers.

10. Lying support according to claim 1, wherein the distance from said additional layer of slats to said lower layer and said upper layer is different.

11. Slatted grid lying support comprising an upper layer of mutually parallel spaced-apart slats, a lower layer of mutually parallel spaced-apart slats, an additional layer of slats arranged between said upper and lower layers of slats and at least two mutually spaced elastic bodies with slat fastening straps on upper and lower sides thereof, wherein said elastic bodies extend perpendicular to said slats and between said upper and lower layers of slats and ends of said upper and lower slats are fastened by insertion into said straps; and wherein said elastic bodies each consist of three separate cushion sections arranged in a row one behind the other and connected to each other at end faces facing towards each other, wherein said additional layer of slats is fixed in the middle cushion section.

12. A slatted grid lying support, comprising:

an upper layer of mutually parallel, spaced apart slats having opposite first and second ends;

a lower layer of mutually parallel, spaced apart slats having opposite first and second ends;

an additional layer of mutually parallel, spaced apart slats positioned between said upper and lower layers and having opposite first and second ends;

a first elastic body located at the first ends of said layers and extending perpendicular to said slats, the first elastic body having an upper side and a lower side;

a second elastic body spaced from said first elastic body and located at the second ends of said layers, the second elastic body extending parallel to said first elastic body and having an upper side and a lower side;

each of said elastic bodies having slat fastening straps on the upper and lower sides thereof;

the opposite first and second ends only of said slats in said upper and lower layers being inserted into said slat fastening straps on the upper and lower sides, respectively, of said first and second elastic bodies to fasten said slats to said elastic bodies; and said elastic bodies having recesses in which the opposite ends of said slats in said additional layer are engaged and held.

13. The support as claimed in claim 12, wherein said slats of said additional layer are positioned offset from said slats of said upper and lower layers.

14. The support as claimed in claim 12, wherein the distance from said additional layer of slats to said lower layer and said upper layer is different.

15. Lying support according to claim 12, wherein each said elastic body is constructed as an individual cushion body, wherein each cushion body is connected on mutually opposed sides to a slat of said upper layer and of said lower layer respectively.

16. Lying support according to claim 15, wherein the cushion bodies are constructed as latex balls, wherein in each of the latex balls a central recess is formed for supporting slats of said additional layer.

* * * * *